US005167272A

United States Patent [19]

Shima et al.

[11] Patent Number: 5,167,272

[45] Date of Patent: Dec. 1, 1992

[54] ADJUSTING A MOLD ADDITIVE FOR CONTINUOUS CASTING

[75] Inventors: Shozo Shima; Yukio Nakamura, both of Kimitsu; Masahiro Nakamura; Masanobu Kanayama, both of Chiba, all of Japan

[73] Assignees: Nippon Steel Corporation; Kamogawa Industry Co., Ltd., Japan

[21] Appl. No.: 670,396

[22] Filed: Mar. 15, 1991

Related U.S. Application Data

[63] Continuation of Ser. No. 465,572, Jan. 18, 1990, abandoned, which is a continuation of Ser. No. 299,170, Jan. 19, 1989, abandoned.

[30] Foreign Application Priority Data

Jan. 21, 1988 [JP] Japan ..... 63-9596

[51] Int. Cl.[5] ..... B22D 27/00

[52] U.S. Cl. ..... 164/473; 164/56.1

[58] Field of Search ..... 164/55.1, 56.1, 473

[56] References Cited

U.S. PATENT DOCUMENTS

| | | | |
|---|---|---|---|
| 3,899,324 | 8/1975 | Corbett | 164/473 |
| 4,204,864 | 5/1980 | Loane, Jr. et al. | 164/473 |
| 4,235,632 | 11/1980 | Uher et al. | 164/473 |
| 4,248,631 | 2/1981 | More et al. | 164/473 |

FOREIGN PATENT DOCUMENTS

| | | | |
|---|---|---|---|
| 2438685 | 10/1979 | France . | |
| 57-41862 | 3/1982 | Japan | 164/473 |

OTHER PUBLICATIONS

Japanese Abstracts-57-41862(A).
Japanese Abstracts-JP 60-234751(A).

*Primary Examiner*—Richard K. Seidel
*Assistant Examiner*—Rex E. Pelto
*Attorney, Agent, or Firm*—Pollock, Vande Sande & Priddy

[57] ABSTRACT

The present invention provides a mold additive for continuous casting which comprises adjusting an additive for stationary casting containing a flux base and, if necessary, a melting property regulator wherein it contains 4–30 wt % of MgO and 4–30 wt % of $ZrO_2$ and $CaO/SiO_2$ is 0.5–1.5.

7 Claims, 2 Drawing Sheets

: AREA WHERE NO BUBBLES OCCURRED

ADJUSTING A MOLD ADDITIVE FOR CONTINUOUS CASTING

This application is a continuation of application Ser. No. 07/465,572 filed Jan. 18, 1990, now abandoned which is a continuation of Ser. No. 299,170, filed Jan. 19, 1989 now abandoned.

BACKGROUND OF THE INVENTION

1. Field of the Invention

The present invention relates to a mold additive for continuous casting of steel.

2. Discussion on Related Art

Mold additives are used in continuous casting of steel for preventing oxidation of the surface of molten steel which contacts with the inner surface of the mold, heat retention, absorption of nonmetal inclusions and lubrication between the mold and the cast product.

A mold additive normally comprises metal oxides such as $SiO_2$, CaO, $Al_2O_3$, MgO and MnO as a flux base material and, if necessary, a melting property regulator comprising metal oxides such as $Na_2O$, $K_2O$, $Li_2O$, and $B_2O_3$ and a metal fluoride such as $CaF_2$, $AlF_3$, NaF and LiF for regulation of melting point and viscosity and a carbonaceous powder for regulation of melting rate.

When a mold additive is added at the surface of the molten steel in a mold, the portion which contacts with the surface of the molten steel melts to form a molten slag layer and unmolten slag layer on the molten slag layer which cover the surface of the molten steel.

The molten slag layer generally used is mainly composed of 25–45 wt % of $SiO_2$, 25–45 wt % of CaO, 1–20 wt % of $Al_2O_3$, 5–20 wt % of $Na_2O$ and 5–20 wt % of F, $CaO/SiO_2$ being 0.5–1.8 and has physical properties of a viscosity of 0.5–15 poises at 1300° C. and a melting point of 900° C.–1250° C.

When the performance of the mold additive is insufficient, there occur problems such as formation of pinholes due to oxidation of steel, breaking-out caused by sticking between the mold and the cast product and formation of cracks on the surface of cast product owing to nonuniform removal of heat.

Therefore, there have been made various proposals to prevent these defects. For example, Japanese Patent Kokai No. 60-234751 discloses a mold additive containing 3–35 wt % of a melting type oxide of 0.01–1 mm in particle size and Japanese Patent Kokai No. 57-41862 discloses a mold additive which is an additive for stationary casting comprising a flux base and, if necessary, a melting property regulator and additionally containing 0.5–15 wt % of zirconia.

However, in the case of the conventional mold additives, the amorphous slag formed upon melting contains some bubbles. These bubbles result in nonuniform cooling of the cast product at the surface of the mold in continuous casting of steel, which causes not only defects in the surface of the cast product, but also breakout. Thus, there have been problems in ensuring the quality of cast product and carrying out a stable operation. According to the above Japanese Patent Kokai No. 60-234751, one or more of magnesia, alumina, forsterite, zircon, wollastonite and silica which have been once molten in an electric furnace to enhance fire resistance and reduce reactivity is used as a slag forming base material to increase the melting temperature of the flux after use. Japanese Patent Kokai No. 57-41862 aims at preventing damage to the dipped nozzle by containing zirconia in the additive and this is not sufficient for decreasing bubbles in the molten slag.

SUMMARY OF THE INVENTION

The present invention which has been accomplished for effectively solving the above-mentioned problems is a mold additive for continuous casting which comprises an additive for stationary casting containing a flux base and, if necessary, a melting property regulator, characterized in that it contains 4–30 wt % of MgO and 4–30 wt % of $ZrO_2$ and that $CaO/SiO_2$ is within the range of 0.5–1.5.

DETAILED DESCRIPTION OF PREFERRED EMBODIMENTS

The present invention will be explained referring to the accompanying drawings below.

Figure 1:
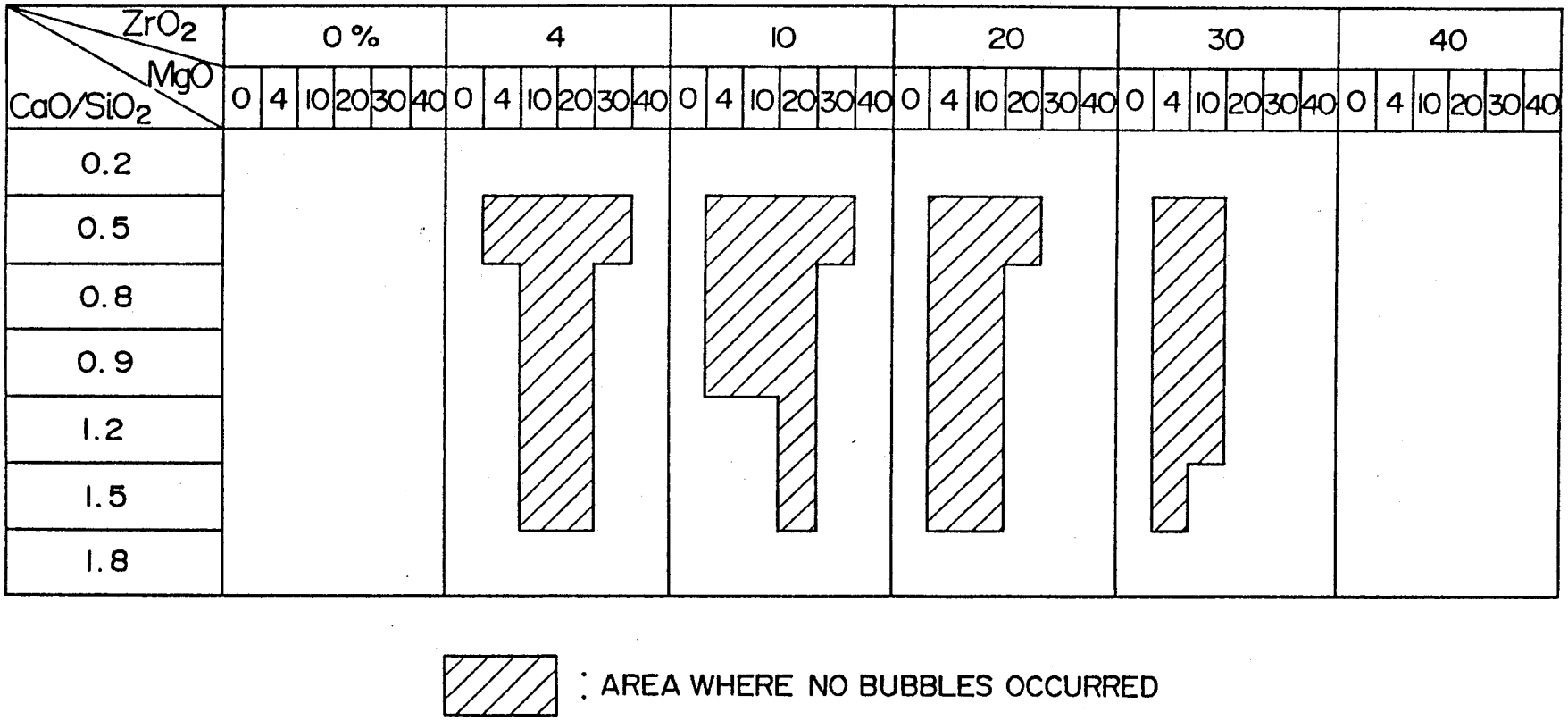
FIG. 1 is a diagram which shows the state of formation of bubbles in molten slag when $ZrO_2$ and MgO are added with changing addition amount thereof to a conventional additive.

FIG. 1 shows the state of formation of bubbles in molten slag when a conventional additive to which $ZrO_2$ and MgO were added with changing amount thereof was used.

From FIG. 1, it will be recognized that when the additive contains 4–30 wt % of $ZrO_2$ and 4–30 wt % of MgO and $CaO/SiO_2$ is within the range of 0.5–1.5, bubbles are not formed in the molten slag.

The additive of the present invention comprises a commercially available additive for stationary casting which contains a flux base to which MgO and $ZrO_2$ are added respectively so as to contain them in specific amounts and $SiO_2$ or CaO may be added so as to adjust the $CaO/SiO_2$ ratio to the specific one.

Furthermore, the additive of the present invention may comprise a commercially available additive for stationary casting which contains a flux base and a melting property regulator in a suitable ratio to which MgO and $ZrO_2$ are added respectively so as to contain them in specific amounts and $SiO_2$ or CaO may be added so as to adjust the $CaO/SiO_2$ ratio to the specific one.

MgO, $ZrO_2$, CaO and $SiO_2$ may be used in the form of industrial chemicals as such or raw ores rich in them which are ground and sieved.

Content of $ZrO_2$ of 4–10 wt % and that of MgO of 4–30 wt % are preferred from the point of prevention of formation of bubbles.

In this case, if the $CaO/SiO_2$ ratio is within the range of 0.5–0.9, good results can be obtained even if the amounts of $ZrO_2$ and MgO are chosen in relatively wide ranges.

Thus, the inventors have succeeded in producing slag containing no bubbles by the simultaneous addition of high melting point materials, MgO and $ZrO_2$ to conventional additives to form a solid solution while keeping $CaO/SiO_2$ within a specified range.

EXAMPLES

To a commercially available additive for stationary casting were added MgO and $ZrO_2$ in the form of industrial chemicals to obtain the additive A of the present invention (present additive A) having the composition as shown in Table 1. Additive B of the present invention (present additive B) was prepared by adding CaO in the form of an industrial chemical to the additive A in such an amount that $CaO/SiO_2$ was 0.9. For comparison, four kinds of commercially available additives were used as conventional additives A, B, C and D.

Characteristics of these additives are shown in Tables 2, 3 and 4.

TABLE 1

(wt %)

| | |
|---|---|
| CaO | 24.3% |
| $SiO_2$ | 29.9% |
| $Al_2O_3$ | 1.7% |
| $Fe_2O_3$ | 0.15% |
| $Na_2O$ | 11.8% |
| F | 7.5% |
| S | 0.06% |
| MgO | 13.1% |
| $ZrO_2$ | 9.2% |
| C | 3.9% |
| $CaO/SiO_2$ | 0.81% |

TABLE 2

(Surface tension)

| Additives | Surface tension (dyn/cm) |
|---|---|
| Present additive A | 393 |
| Present additive B | 399 |
| Conventional additive A | 367 |
| Conventional additive B | 387 |
| Conventional additive C | 369 |
| Conventional additive D | 389 |

TABLE 3

(Break point and properties)

| | B.P (°C.) | B.P.T. (min) | M.P. (°C.) | Viscosity η (P) (at 1300° C.) | $CaO/SiO_2$ |
|---|---|---|---|---|---|
| Present additive A | 1030 | 21' | 1060 | 3 | 0.8 |
| Present additive B | 1060 | 16'30" | 1050 | 3.5 | 0.9 |
| Conventional additive A | 1030 | 13'30" | 1070 | 2.3 | 0.8 |
| Conventional additive B | 1120 | 7'00" | 1080 | 4.5 | 0.8 |
| Conventional additive C | 1073 | 7'50" | 980 | 0.9 | 1.05 |
| Conventional additive D | 1160 | 5'20" | 1090 | 1.8 | 1.02 |

TABLE 4

(Specific gravity)

| | Specific gravity |
|---|---|
| Present additive A | 3.1 |
| Present additive B | 3.1 |
| Conventional additive A | 2.8 |
| Conventional additive B | 2.8 |
| Conventional additive C | 2.8 |
| Conventional additive D | 2.8 |

As explained above, according to the present invention, a slag in the form of a solid solution which contains no bubbles exerts lubricating action between solidified shell and cooling mold in the continuous casting of steel and a good cast product can be obtained by a stable amount of heat removed.

Figure 2:
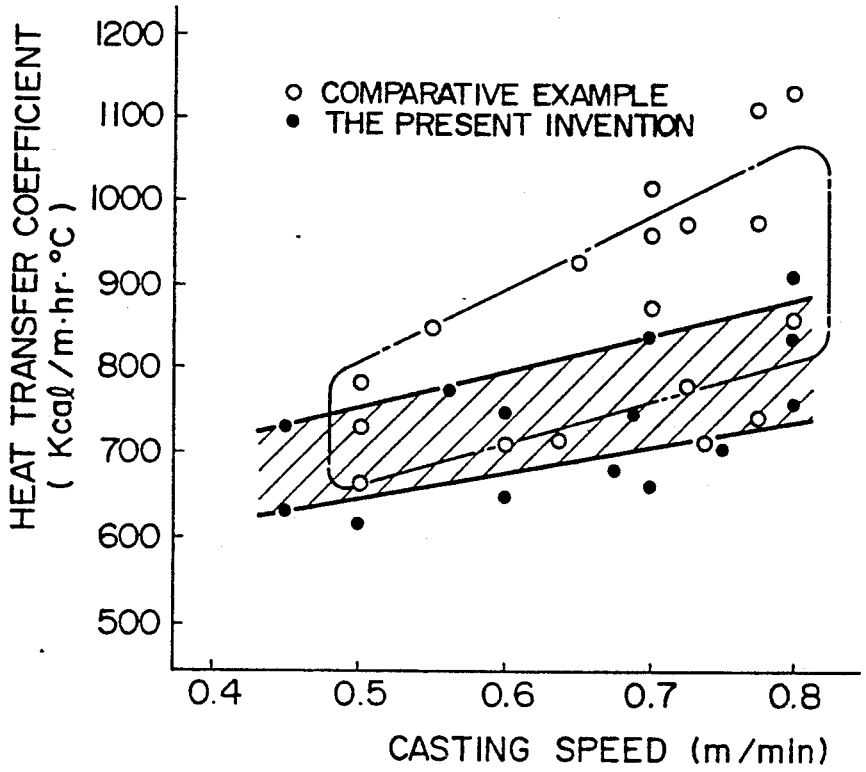
FIG. 2 is a graph which shows heat transfer coefficient depending on casting rate in the present invention and comparative example.
Figure 3:
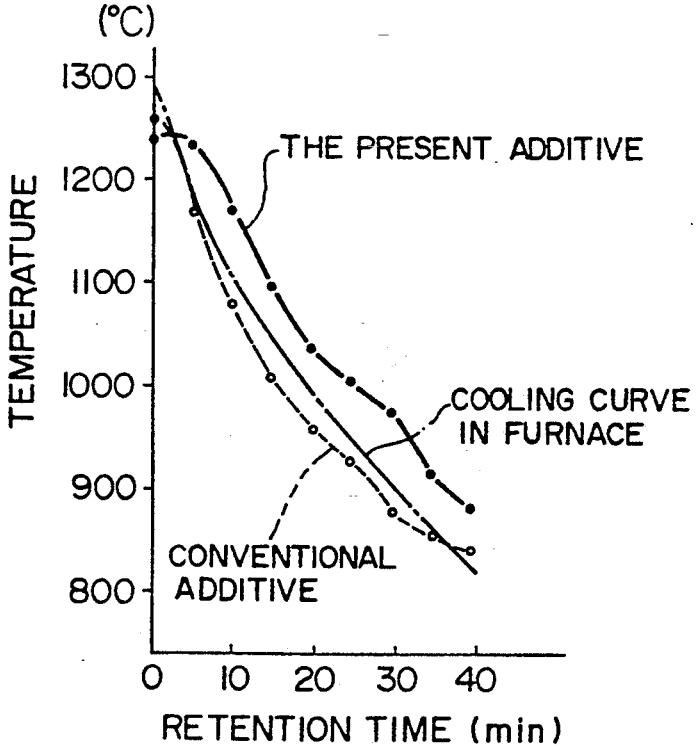
FIG. 3 is a graph which shows heat retaining property exhibited by the additive of the present invention and that of comparative example.

According to the present invention, since the slag which flows between cooling mold and solidified shell does not form bubbles in the continuous casting, a cast product is uniformly cooled and as a result, as shown in FIG. 2, removal of heat in a stable amount can be attained on the surface of the cast product and besides, the heat-retaining property of the slag is excellent as shown in FIG. 3. For this reason, removal of heat in the cooled mold at casting is relaxed and the cast product is gently cooled whereby formation of deckle in the cooling mold can be prevented and occurrence of defects on the surface and inside of the cast product can be prevented.

Furthermore, the additive of the present invention is high in surface tension (Table 2) and in viscosity (Table 3) and nevertheless, it has a long break point time (Table 3) and the slag which flows between the cooling mold and solidification shell in the vicinity of meniscus part does not become a sticking layer and further, since it has a great specific gravity (Table 4), the proper amount of slag can be secured corresponding to a change in meniscus part and interface between the slag and molten steel. That is, it becomes possible to produce steels of from low carbon content to high carbon content by one formulation of additive.

As explained above, according to the present invention, bubbles are not generated in the molten slag in the mold and hence the conspicuous effects are exhibited that removal of heat in the cooling mold at casting is made uniform and defects on the surface and inside of the cast product can be prevented and besides there is no need to change additives depending on the kind of steel and thus a stable operation can be performed.

What is claimed is:

1. A method for preventing bubble formation in a slag in a process for continuously casting molten steel comprising:

adjusting the contents of a commercially available additive containing a flux base for stationary casting by adding MgO or $ZrO_2$ or both to provide a slag-forming composition containing MgO and $ZrO_2$ each in a concentration of 4–30 wt. % and $CaO/SiO_2$ in a weight ratio of 0.5–1.5;

adding the resulting slag-forming composition to molten steel, thereby forming a substantially bubble-free slag; and, continuously casting the resulting molten steel.

2. A method according to claim 1 wherein the content of the commercially available additive containing a flux base is adjusted to contain 4–30 wt % MgO and 4–10 wt % $ZrO_2$.

3. A method according to claim 2 wherein the content of the commercially available additive containing a flux base is adjusted to contain CaO and $SiO_2$ in a weight ratio $CaO/SiO_2$ of 0.5–0.9.

4. A method according to claim 1 wherein the commercially available additive containing a flux base contains a melting property regulator.

5. A method in accordance with claim 1 wherein said commercially available additive containing a flux base is substantially free of MgO and $ZrO_2$.

6. A method in accordance with claim 1 wherein said commercially available additive containing a flux base consists essentially of 25–45% CaO, 25–45% $SiO_2$, 1–20% $Al_2O_3$, 5–20% $Na_2O$ and 5–20% F.

7. A method for preventing bubble formation in a slag in a process for continuous casting molten steel, said method comprising:

providing a commercially available flux base containing 25–45% CaO, 25–45% $SiO_2$, 1–20% $Al_2O_3$, 5–20% $Na_2O$ and 5–20% F;

adding sufficient MgO and $ZrO_2$ to said flux base to form a slag-forming composition containing each of MgO and $ZrO_2$ in a concentration of 4–30 wt. %, said composition further containing CaO and $SiO_2$ in a weight ratio $CaO/SiO_2$ of 0.5–1.5;

adding the resulting slag-forming composition to molten steel, thereby forming a substantially bubble-free slag; and, continuously casting the resulting molten steel.

* * * * *